US007330155B2

(12) United States Patent
Chan et al.

(10) Patent No.: US 7,330,155 B2
(45) Date of Patent: Feb. 12, 2008

(54) ANTENNA SYSTEM

(75) Inventors: Yiu K. Chan, Vernon Hills, IL (US); Antonio Faraone, Plantation, FL (US); Carlo DiNallo, Plantation, FL (US); Istvan J. Szini, Grayslake, IL (US)

(73) Assignee: Motorola Inc., Schaumburg, IL (US)

( * ) Notice: Subject to any disclaimer, the term of this patent is extended or adjusted under 35 U.S.C. 154(b) by 113 days.

(21) Appl. No.: 11/168,950

(22) Filed: Jun. 28, 2005

(65) Prior Publication Data

US 2006/0290572 A1 Dec. 28, 2006

(51) Int. Cl.
*H01Q 1/24* (2006.01)

(52) U.S. Cl. ..... 343/702

(58) Field of Classification Search ..... 343/702, 343/700 MS, 895, 720, 725, 834
See application file for complete search history.

(56) References Cited

U.S. PATENT DOCUMENTS 2,432,057 A * 12/1947 Wheeler ..... 343/830
5,422,650 A * 6/1995 Hill ..... 343/713
6,028,567 A * 2/2000 Lahti ..... 343/895
6,040,803 A * 3/2000 Spall ..... 343/700 MS
6,124,831 A * 9/2000 Rutkowski et al. .. 343/700 MS
6,232,925 B1 * 5/2001 Fujikawa ..... 343/702
6,359,594 B1 * 3/2002 Junod ..... 343/744
6,456,246 B2 * 9/2002 Saito ..... 343/702
6,677,905 B2 * 1/2004 Deguchi et al. ..... 343/702
6,762,723 B2 7/2004 Nallo et al.
2001/0040528 A1 * 11/2001 Vaisanen et al. ..... 343/700 MS

* cited by examiner

*Primary Examiner*—Huedung Mancuso
(74) *Attorney, Agent, or Firm*—Sylvia Chen

(57) ABSTRACT

A wireless communication device (600) with an antenna system (602) is disclosed. The antenna system (100) is an internal antenna with broadband characteristics which provides coverage over multiple frequency bands. The antenna system (100) has a finite ground surface (102), an elongated conductor (104) supported by a dielectric spacer (106), and at least one series signal feed (110).

18 Claims, 7 Drawing Sheets

ANTENNA SYSTEM

FIELD OF THE INVENTION

This invention relates in general to antenna systems, and more specifically to an antenna system for a wireless communication device.

BACKGROUND OF THE INVENTION

An antenna is a medium for radiating and receiving electromagnetic waves. Over the years, the design and performance of antennas for wireless communication devices has gained significant importance. Key technological aspects involved in the development of an antenna for a wireless communication device include compactness of the antenna, complete built-in structure of the antenna, and multi-band operation of the antenna.

To efficiently radiate an electromagnetic wave into free space, the size of the antenna should be of the order of the wavelength radiated, which is inversely proportional to the frequency. For example, a wavelength at 900 MHz, used in the GSM system, is 330 mm, which is much larger than the size of wireless communication devices currently in use. Generally, the operational frequency of a wireless device has a long wavelength relative to the size of the handset. In particular, the terms 'compact size' and 'broad bandwidth' generally conflict with each other. Therefore, the design of an antenna embedded in a wireless communication device should be small yet should handle frequencies that generally require larger antenna dimensions.

In contrast to external antennas, complete built-in antennas are installed within a housing of a wireless device. The advantages of a complete built-in antenna include reinforcement of shock resistance, consistent antenna efficiency, reduction of manufacturing costs, etc. Therefore, requests for complete built-in antennas for wireless communication devices are growing.

A multi-band antenna is one that can be used in more than one frequency band. There are different communication protocols utilizing different frequency bands. Examples of communication protocols include AMPS, GSM 800, GSM 900, GSM 1800, GSM 1900, and UMTS. It is desirable that wireless communication devices that are capable of operating according to more than one communication protocol are produced. This may necessitate signals being radiated and received in different frequency bands.

Therefore, there is an opportunity to develop compact-sized internal antennas, capable of operating in multiple frequency bands (rather than with separate antennas for different bands).

BRIEF DESCRIPTION OF THE DRAWINGS

The present invention is illustrated by way of example, and not limitation, in the accompanying figures, in which like references indicate similar elements, and in which.

Figure 1:
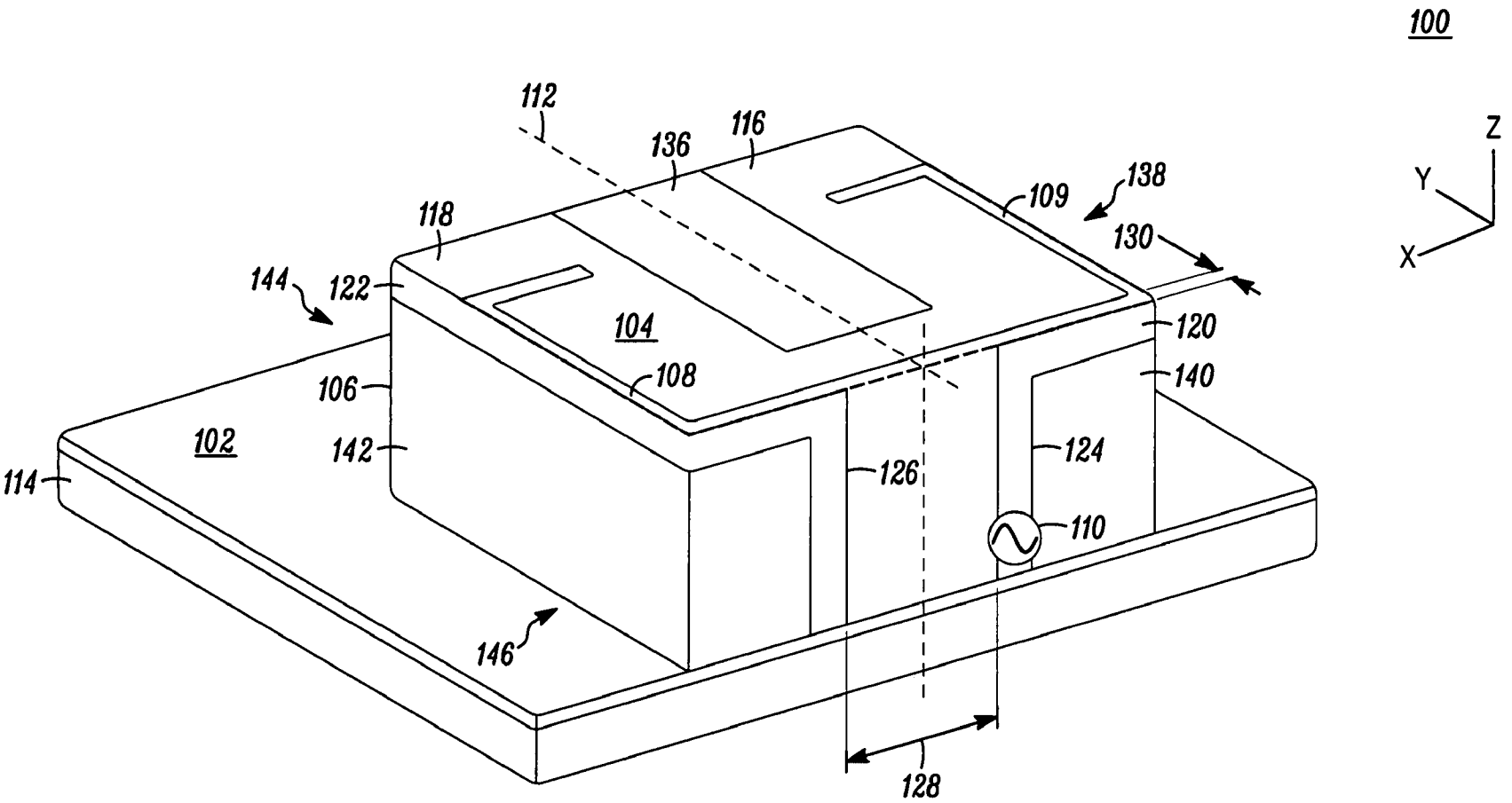
FIG. 1 is a perspective view of an antenna system, in accordance with a first exemplary embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of the embodiments shown.

DETAILED DESCRIPTION

Before describing in detail the particular antenna system embodiments, it should be observed that apparatus components have been represented where appropriate by conventional symbols in the drawings, showing only those specific details that are pertinent to understanding the present invention so as not to obscure the disclosure with details that will be readily apparent to those of ordinary skill in the art having the benefit of the description herein.

An antenna system for sending and receiving signals in a plurality of frequency bands is disclosed. The antenna system has a finite ground surface, an elongated conductor, and at least one series signal feed. The elongated conductor includes a slit along at least one edge of the elongated conductor. The signal feed is a series feed in series with the elongated conductor. Also, a wireless communication device with an antenna system for sending and receiving signals in a plurality of frequency bands is disclosed. The wireless communication device further includes a series signal feed provided in series to the antenna system.

FIG. 1 is a perspective view of an antenna system 100, in accordance with a first exemplary embodiment. The antenna system 100 is used for sending and receiving signals in a wireless communication network. The antenna system 100 can be implemented as an internal antenna embedded in a wireless communication device with broadband characteristics.

The antenna system 100 includes a finite ground surface 102, an elongated conductor 104 with two slits 108, 109, and a series signal feed 110. In this embodiment, the finite ground surface 102 is one layer of a multi-layer circuit board 114. The multi-layer circuit board 114 supports and interconnects various electrical components in the wireless communication device, for example, a microphone (MIC), a liquid crystal display (LCD), a battery, a speaker, a vibrator, an LCD connector, a battery connector, etc. In an alternate embodiment, the finite ground surface 102 includes several connected layers of the multi-layer circuit board 114.

The elongated conductor 104 is used in the transmission and reception of electromagnetic energy by converting radio waves into electrical signals and vice versa. The elongated conductor 104 lies on one or more surfaces of a dielectric spacer 106. In this embodiment, the elongated conductor 104 is integrally formed on the dielectric spacer 106 by lithographic etching or printing. Alternately, the elongated conductor 104 can be formed independently and later placed on the dielectric spacer 106. The elongated conductor 104 shown is symmetrical with a central plane 112, although it is not necessary to have exact symmetrical geometry for the elongated conductor 104. In this embodiment, the elongated conductor 104 is made of a metal sheet.

The elongated conductor 104 includes a first top end 116, a second top end 118, a first leg 120, and a second leg 122. The dielectric spacer 106 is a hollow box has a first surface 136, a second surface138, a third surface140, a fourth surface 142, a fifth surface 144, and a sixth surface 146. The first top end 116 lies on the first surface 136 on a first side of the central plane 112. The second top end 118 lies on the first surface 136 on a second side of the central plane 112. The first leg 120 lies on the second surface 138 and the third surface 140 on the first side of the central plane 112. The second leg 122 lies on the third surface 140 and the fourth surface 142 on the second side of the central plane 112. The first top end 116, the second top end 118, the first leg 120, and the second leg 122 of the elongated conductor 104 can have variable shapes and widths.

In this embodiment, the elongated conductor 104 is orthogonally meandered, which means that the elongated conductor 104 is curved over at least three substantially perpendicular surfaces 136, 138, 140 of the dielectric spacer 106. In the antenna system 100 of FIG. 1, the first top end 116, the second top end 118, the first leg 120, and the second leg 122 are curved over at least three perpendicular surfaces 136, 138, 140 of the dielectric spacer 106. In this example, a fourth surface 142 parallel to surface 138 but perpendicular to surfaces 136 and 140 is part of the orthogonal meandering. Note that, due to implementation of the antenna system 100 in device housings that have curves, the orthogonal meandering need not be perfectly orthogonal in order to achieve the desired bandwidth and compactness characteristics.

In this embodiment, the first top end 116 and the second top end 118 are symmetrical across the central plane 112 although it is not necessary to have the first top end 116 and the second top end 118 to be symmetrical across the central plane 112. Similarly, the first leg 120 and the second leg 122 are symmetrical across the central plane 112 although it is not necessary to have the first leg 120 and the second leg 122 to be symmetrical across the central plane 112.

The dielectric spacer 106 supports the elongated conductor 104 on the finite ground surface 102. The dielectric spacer 106 is preferably made of a low-loss material such as polyimide. In this embodiment, the dielectric spacer 106 is made of plastic material such as epoxy-fiber-glass. In this embodiment, the size of the dielectric spacer 106 corresponds to $\lambda/4$ by $\lambda/8$ by $\lambda/16$ in x, y and z axes, respectively, where $\lambda$ is the wavelength associated with the frequency of interest $2f_0$ (where $2f_0$ is the mean frequency position of the upper bands of interest). The x, y and z axes are as shown in FIG. 1. In this embodiment, the antenna system 100 has a ground clearance of 10 millimeter (mm) and is constrained to the dielectric spacer 106 of size 36 mm by 24 mm by 10 mm with wall thickness of 0.5 mm. In an extension of this embodiment, the air space within the dielectric spacer 106 accommodates a polyphonic speaker, with an insignificant drop in the radiation performance of the antenna system 100. Thus, the elongated conductor 104 is accommodated in a manner that is efficient in terms of the use of available space within a housing of a wireless device. In as much as it is desirable to make small wireless communication devices, efficient use of space is beneficial.

Along the sides of the dielectric spacer 106, the elongated conductor 104 has two slits 108, 109. One part of the first slit 109 is an air gap between the first top end 116 and the first leg 120; one part of the second slit 108 is the air gap between the second top end 118 and the second leg 122. The slits 108, 109 form an edge-line transmission line. The edge-line transmission line transmits or guides radio-frequency energy from one point to another. The slits 108, 109 being on one or more edges of the elongated conductor 104 augments the bandwidth of operation of the antenna system 100. In this embodiment, the length of each slit 108, 109 on either side of the central plane 112 is $\lambda/4$ long, which corresponding to the center frequency position of the highest frequency band of interest. Although the slits 108, 109 shown have a constant width, the width of the slits 108, 109 could be variable. In this embodiment, the width of the slits 108, 109 is 1 mm. In another embodiment, the width of slits 108, 109 may be tapered or varied incrementally in a step-wise fashion.

A first portion 124 at an end of the first leg 120 and a first portion 126 at the end of the second leg 122 are widely spaced at a distance 128. The wide spacing of the first portion 124 of the first leg 120 and a first portion 126 of the second leg 122 reduces dissipation loss. The distance 128 is at least twice the adjacent slit width 130, which is generally at least 1 mm. In this embodiment, the distance 128 corresponds to $\lambda/16$ where $\lambda$ is the wavelength associated with the upper frequency of interest at $2f_0$, where $f_0$ is the center of the lowest frequency of interest.

The elongated conductor 104 is provided with a series signal feed 110 (as opposed to a shunt signal feed). The signal feed 110 produces a uniform traveling wave of a desired frequency of the radio wave. As shown in FIG. 1, the first portion 124 of the first leg 120 and the first portion 126 of the second leg 122 are not connected, hence the series signal feed 110. On the other hand, if the first portion 124 of the first leg 120 and the first portion 126 of the second leg 122 were shorted or bridged by a relatively low impedance conductor or network (where the network may be one or more reactive components in any topology), the signal feed would be a shunt (or parallel) signal feed.

In this embodiment, the antenna system 100 is a single-feed system, with the series signal feed 110 being provided through a single port. In an alternate embodiment, the low-cost and simple single port can be expanded to a two-port system for two phase-coherent signal sources. In this situation, a second port can be added in series with the first portion 126 of the second leg 120. The second port would provide a signal that has a common phase relationship in the lower frequency band $f_0$ and a difference phase relationship in the higher frequency band 2 $f_0$.

The antenna system 100 is intended for incorporation into a wireless communication device such as a multi-band communication device. The wireless communication device would include a housing enclosing the multi-layer circuit board 114 and the antenna system 100. The shape of the elongated conductor 104 and that of the dielectric spacer 106 would match the contour of the housing. For example, instead of the box dielectric spacer shown, the dielectric spacer could be more curved to fit better into a more curvy housing.

The antenna system 100 is applicable to mobile handsets, wireless LAN-enabled devices, satellite/GPS devices, etc. The antenna system 100 exhibits broadband capabilities that allow operation on several frequency bands. Broadband operation is useful for providing adequate bandwidth to accommodate multiple communication protocols, e.g., Global System for Mobile Communications (GSM) in nominal 850 MHz as well as in nominal 900 MHz bands. In this embodiment, the antenna system 100 provides coverage over five frequency bands. The five frequency bands include AMPS (800 MHz), GSM (900 MHz), DCS (1800 MHz), PCS (1900 MHz), and UMTS (2170 MHz). Further, the antenna system 100 provides five-band operation without any frequency tuning control.

The design of the antenna system 100 uses a Reverse Reactance Compensation method to suppress antenna reactance in adjacent bands, to result in extended frequency response for broadband operation. The Reverse Reactance Compensation method utilizes two embedded $\lambda/4$ edge-line transmission lines for bandwidth extension. Further, the two edge-line transmission lines employ varying impedance to extend the compensation bandwidth and promote the bandwidth of operation of the antenna system 100. In these examples, a two edge-line transmission line is represented by two slits.

Figure 2:
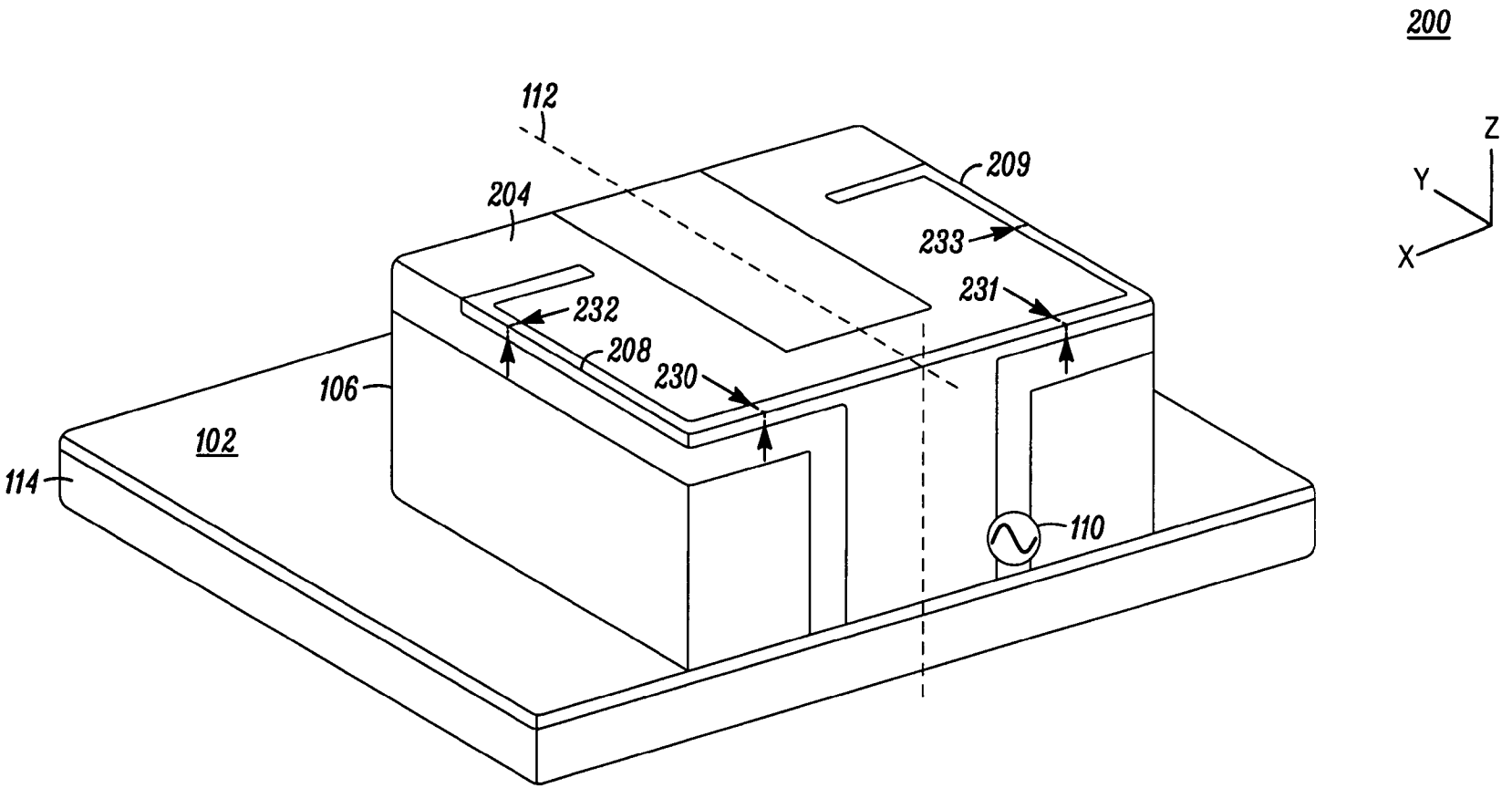
FIG. 2 is a perspective view of an antenna system, in accordance with a second exemplary embodiment.

FIG. 2 is a perspective view of an antenna system 200, in accordance with a second exemplary embodiment. This second embodiment is similar to the first embodiment with the exception of the geometry of the slits 208, 209. In this embodiment, two slits 208, 209 of the elongated conductor 204 are selectively widened on more than one surface of the dielectric spacer 106 at widths 230 and 232 and their mirror counterpart widths 231 and 233. The progressive widening of the slits 208, 209 further promotes bandwidth of operation and also improves the compensation bandwidth of the antenna system 200. In this embodiment, the widened slit widths 230, 231, 232, 233 are 2 mm on one or more surfaces of the dielectric spacer 106. In an alternate embodiment, the slits may be tapered. Also, the slit widths 230, 231, 232, 233 can differ, the length of the slits 208, 209 can be adjusted, and the slit widths 230, 231, 232, 233 need not be identical in order to achieve the desired antenna characteristics.

Figure 3:
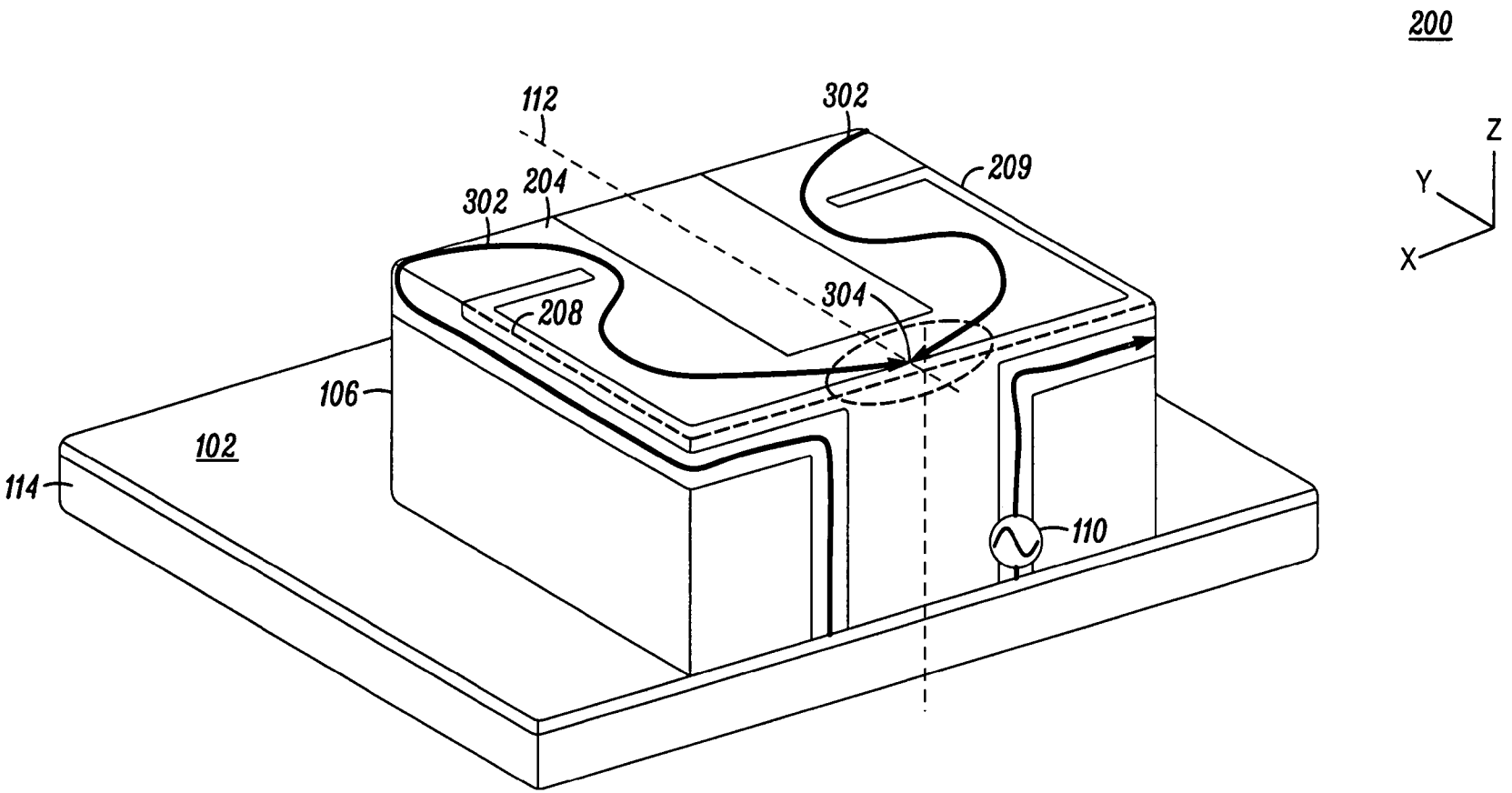
FIG. 3 is a perspective view of the antenna system of FIG. 2, illustrating the standing current wave polarity on an elongated conductor when operating in a first, common electromagnetic mode.

FIG. 3 is a perspective view of the antenna system 200 of FIG. 2 illustrating the phase relationship of two standing current waves on the elongated conductor 204 when operating in a first, common electromagnetic mode. In the common mode, the standing current phase is generally mirror-symmetric with respect to the central plane 112. The standing current phase is in opposite directions on opposite sides of the central plane 112. First primary standing waves 302 are shown for low frequency band operation. Exemplary low-frequency bands include 800 MHz and 900 MHz frequency bands. A point 304 represents the common mode high electric field section. The common mode high electric field section represents where the electric field associated with the elongated conductor 204 is highest in the common mode.

Figure 4:
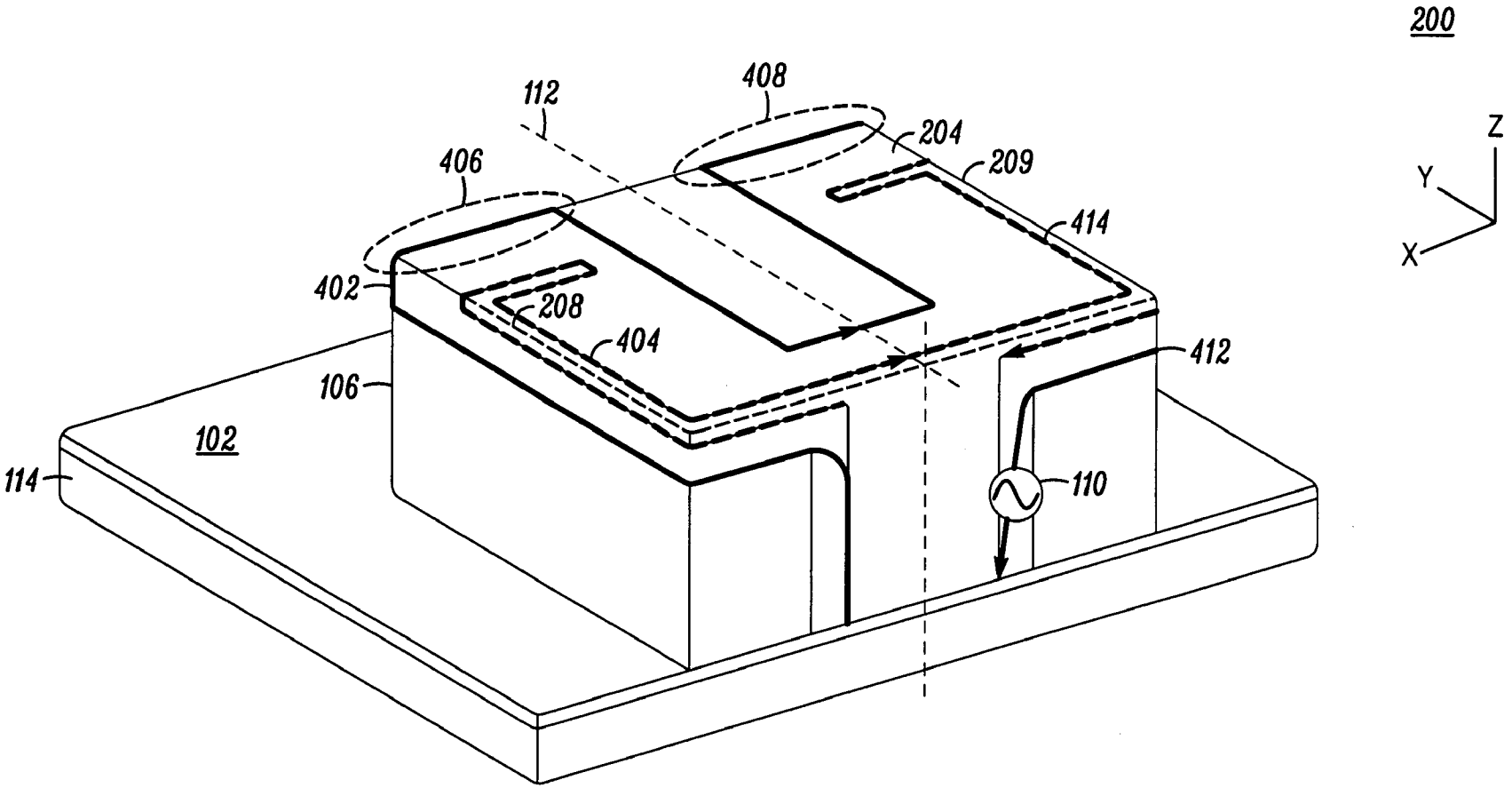
FIG. 4 is a perspective view of the antenna system of FIG. 2, illustrating the standing current wave polarity on an elongated conductor when operating in a second, differential electromagnetic mode.

FIG. 4 is a perspective view of the antenna system 200 of FIG. 2 illustrating the current wave polarity on the elongated conductor 204, when operating in a second, differential electromagnetic mode. In the differential mode, the standing current phase is anti-symmetric with respect to the central plane 112. In the differential mode, the standing current phase is in the same direction at different points along the length of the conductor 204, at any given instant in time. A first primary standing wave 402 and a compensating standing wave 404 are shown for high frequency band operation. A second primary standing wave 412 and second compensating standing wave 414 also take place across the plane 112 of symmetry. The high frequency band includes the 1800 MHz, 1900 MHz and 2170 MHz frequency bands. The areas 406 and 408 highlight the difference mode high electric field section. The difference mode high electric field section is the area where the electric field associated with the elongated conductor 204 is highest in the differential mode.

Figure 5:
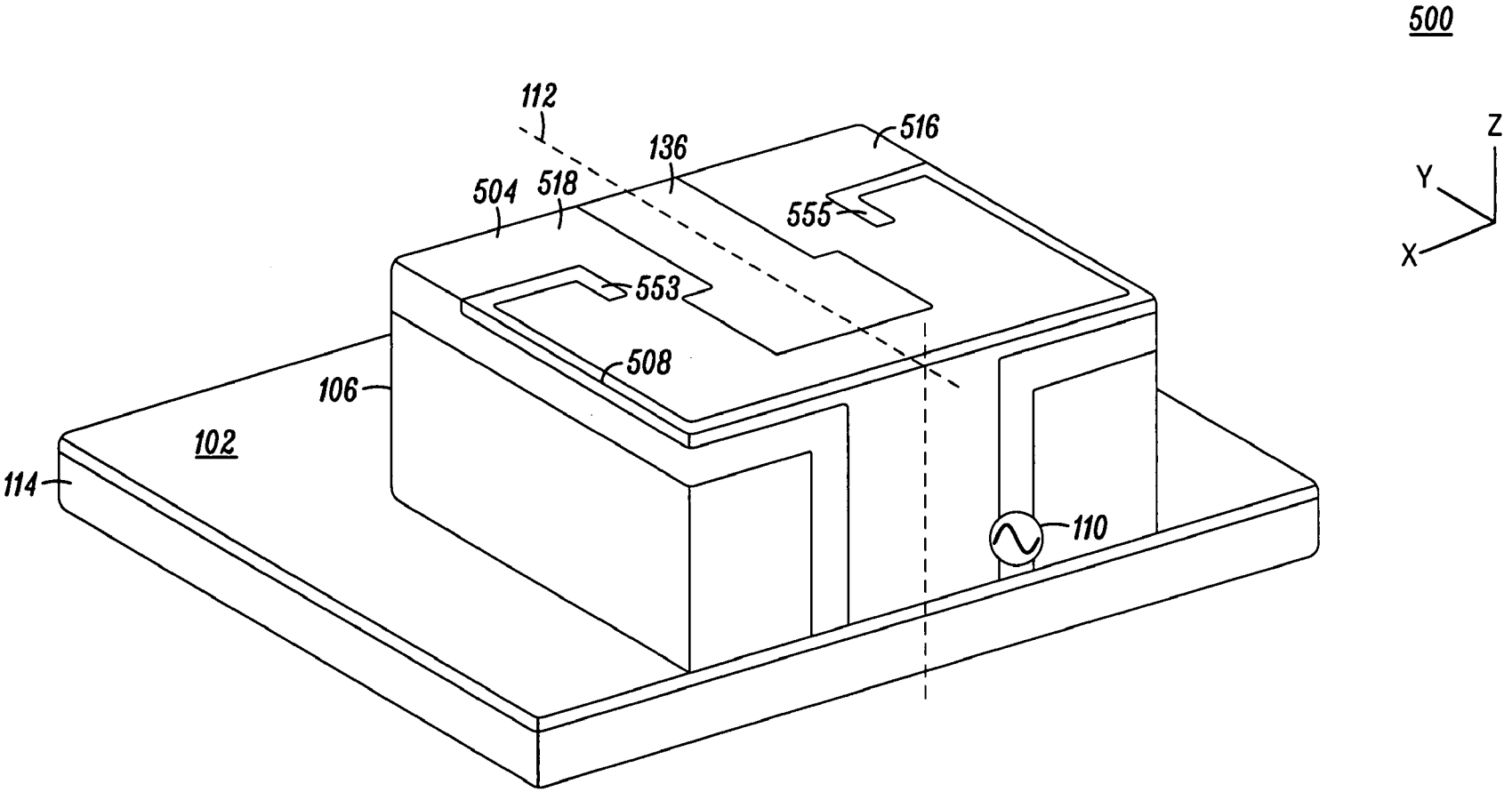
FIG. 5 is a perspective view of an antenna system, in accordance with a third exemplary embodiment.

FIG. 5 is a perspective view of an antenna system 500, in accordance with a third exemplary embodiment. The antenna system 500 includes a two slits 508, 509. The other elements of the antenna system 500 are similar to elements of the antenna system 200 of FIG. 2 except for the geometry of the elongated conductor 504 along the top surface 136. The slits 508, 509 are selectively extended on one or more surfaces of the dielectric spacer 106 relative to the slits 208, 209 shown in FIG. 2. The selective extension of the slits 508, 509 further promotes the bandwidth of operation and also improves the compensation bandwidth of the antenna system 500. As shown in FIG. 5, the two ends 553 and 555 of the slits 508, 509 on the top surface 136 of the dielectric spacer 106 are extended and step-wise tapered. In this embodiment, the width of the tapered ends 553 and 555 of the slits 508, 509 is less than or equal to 1 mm while other widths of the slits 508, 509 are greater than 1 mm.

Also the geometry of the first top end 516 and the second top end 518 has been modified to improve the antenna system's efficiency at the frequencies of interest. Other geometries, such as the length and width of the elongated conductor 504 along any of the sides of the dielectric spacer 106 can be optimized for the frequencies of interest.

Figure 6:
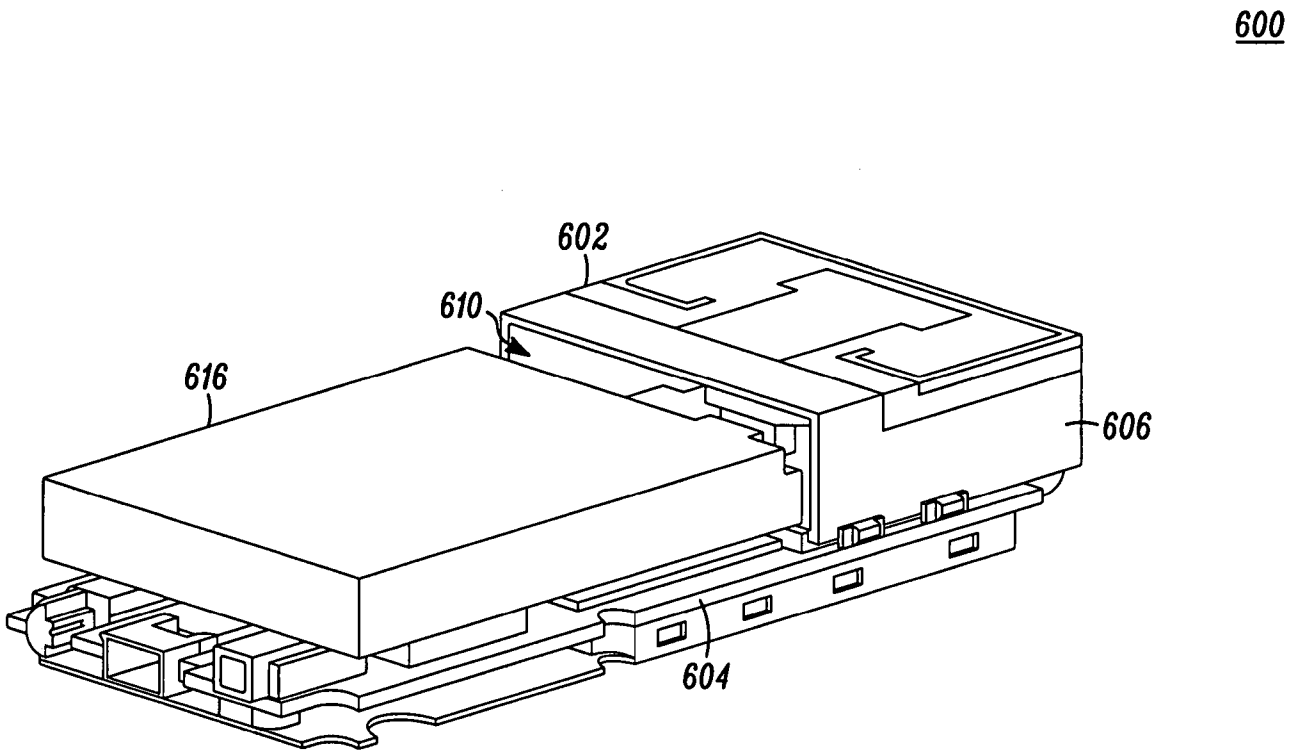
FIG. 6 shows a view of a wireless communication device, in accordance with an exemplary embodiment.

FIG. 6 is a view of a wireless communication device 600 with an antenna system, in accordance with an exemplary embodiment. The wireless communication device 600 includes an antenna system 602, a multi-layer circuit board 604, and a battery 616. The antenna system 602 is similar to the antenna system 500 shown in FIG. 5. The multi-layer circuit board 604 is similar to the multi-layer circuit board 114 shown in FIG. 5. The wireless communication device 600 also includes other components (not shown in FIG. 6), such as a microphone, a keypad, a display, a speaker, and a plurality of electrical circuit components held in a housing. As described previously, components such as a polyphonic speaker can be placed inside the air space 610 within the dielectric spacer 606 (similar to the previously-described dielectric spacer 106) to make more efficient use of the volume inside a housing of the wireless communication device 600.

At least some of the electrical circuit components that make up the communication device are supported by and interconnected by the multi-layer circuit board 604. The shape of the dielectric spacer supporting the antenna system 602 conforms to the shape of the housing, thereby facilitating the inclusion of the antenna system 602 in the wireless communication device 600 in a space-efficient manner.

Figure 7:
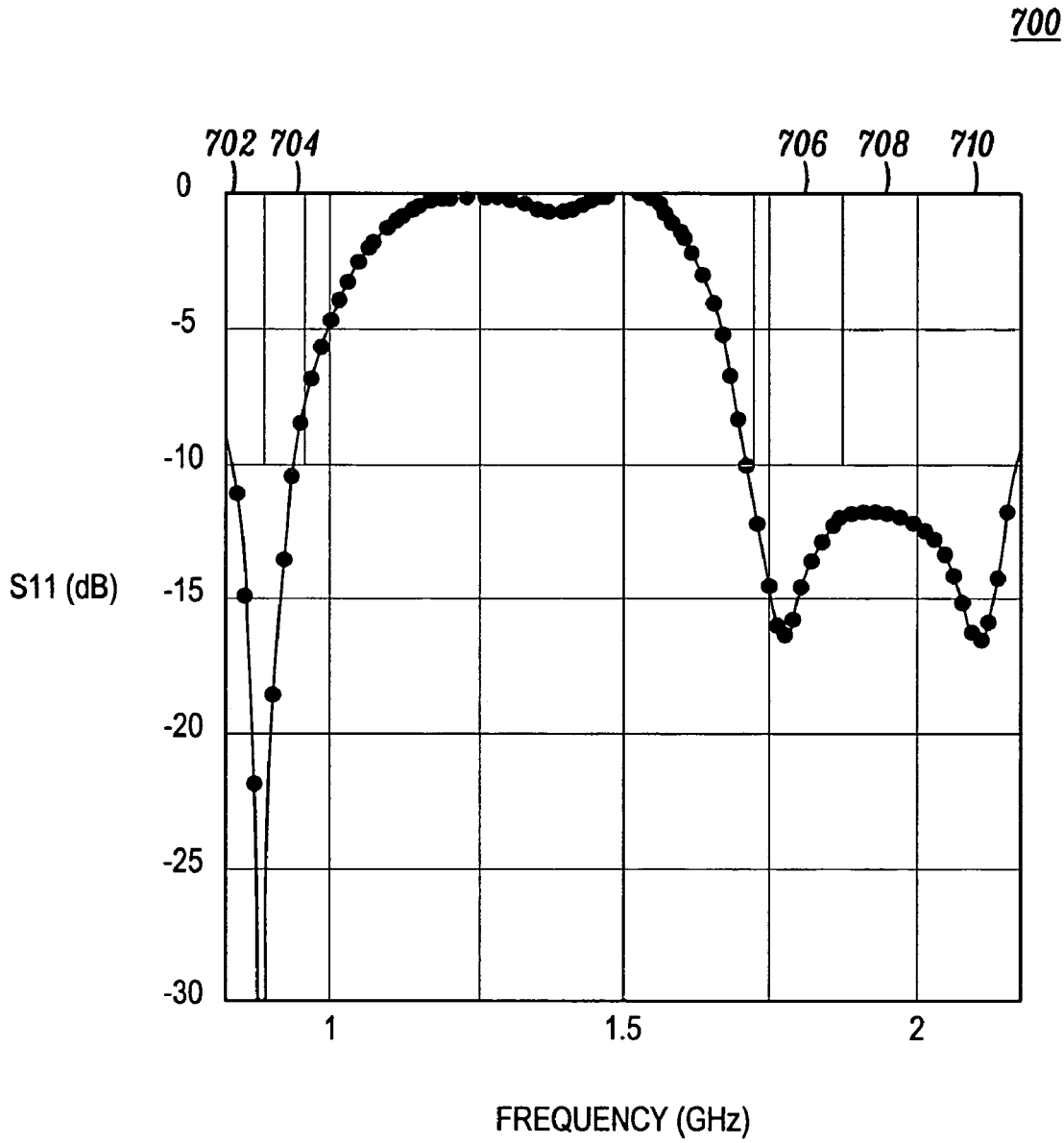
FIG. 7 is a return loss plot of an antenna system, in accordance with an exemplary embodiment shown in FIG. 6.

FIG. 7 is a return loss plot 700 for the wireless communication device 600 shown in FIG. 6. The return loss plot 700 exhibits five bands of operation 702, 704, 706, 708, and 710, centered at approximately 800 MHz, 900 MHz, 1800 MHz, 1900 MHz and 2170 MHz, respectively. Thus, the antenna system 500 shown in FIG. 5 is able to support communications in a plurality of frequency bands.

The antenna system described in various embodiments exhibits a compact internal antenna system capable of being embedded in a wireless communication device. The antenna system has broadband capabilities that enable operation on several frequency bands, such as AMPS, GSM, DCS, PCS, and UMTS. Further, the multi-band operation of the antenna system does not require any frequency tuning control. The antenna system exhibits high gain, improved efficiency and reduced power needs.

In this document, relational terms such as first and second, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

The term "another", as used herein, is defined as at least a second or more. The terms "including" and/or "having", as used herein, are defined as comprising. The term "coupled", as used herein with reference to electrical technology, is defined as connected, although not necessarily directly, and not necessarily mechanically.

In the foregoing specification, the invention and its benefits and advantages have been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. An antenna system, for operation in common mode and differential mode, comprising:

a finite ground surface;

an orthogonally meandered elongated conductor spaced from the finite ground surface including:

a first slit, the first slit having a widest slit width;

a first leg having a first portion; and a second leg having a second portion spaced at a distance from the first portion at least as great as twice the widest slit width; and a series signal feed provided in series with the first leg of the orthogonally meandered elongated conductor.

2. The antenna system of claim 1 incorporated into a wireless communication device.

3. The antenna system of claim 2, wherein the wireless communication device is a multi-band communication device.

4. The antenna system of claim 1, wherein the orthogonally meandered elongated conductor has a second slit.

5. The antenna system of claim 4, wherein the orthogonally meandered elongated conductor is symmetrical with respect to a central plane.

6. The antenna system of claim 1, comprising a dielectric spacer supporting the orthogonally meandered elongated conductor on the finite ground surface.

7. The antenna system of claim 6, wherein the dielectric spacer corresponds to $\lambda/4$ by $\lambda/8$ by $\lambda/16$, where $\lambda$ is a wavelength associated with a frequency of interest.

8. The antenna system of claim 6, wherein the dielectric spacer is hollow.

9. The antenna system of claim 1, wherein the first slit extends across two adjacent surfaces.

10. The antenna system of claim 1, wherein the first slit is tapered.

11. The antenna system of claim 1, wherein the first slit is tapered step-wise.

12. The antenna system of claim 1, wherein a length of the first slit corresponds to $\lambda/4$, wherein $\lambda$ is a wavelength associated with a frequency of interest.

13. A wireless communication device comprising:

an antenna system, for operation in common mode and differential mode, comprising:

an electrical ground surface;

an elongated conductor spaced from the electrical ground surface, wherein the elongated conductor comprises:

a first top end with a first edge-line slit extending on one or more surfaces, the first edge-line slit having a widest slit width;

a second top end with a second edge-line slit extended on one or more surfaces;

a first leg;

a second leg spaced from the first leg at a distance at least as great as twice the widest slit width; and a signal feed provided in series with the first leg.

14. The wireless communication device of claim 13, wherein the wireless communication device is a multi-band communication device.

15. The wireless communication device of claim 13, wherein the antenna system is supported on the electrical ground surface by a dielectric spacer.

16. The wireless communication device of claim 13, wherein the first top end and the second top end are symmetrical with respect to a central plane.

17. The wireless communication device of claim 13, wherein the first leg and the second leg are symmetrical with respect to a central plane.

18. A wireless communication device comprising:

a multi-layer circuit with a ground layer;

an orthogonally meandered elongated conductor for operation in common mode and a differential mode coupled to the ground layer, the orthogonally meandered elongated conductor having:

a first slit extending on at least one surface with a widest slit width;

a first leg; and a second leg spaced at a distance from the first portion at least as great as twice the widest slit width;

a series signal feed provided in series with the first leg; and a housing enclosing the multi-layer circuit and the orthogonally meandered elongated conductor.

* * * * *